US007213844B2

(12) United States Patent
Malette et al.

(10) Patent No.: US 7,213,844 B2
(45) Date of Patent: May 8, 2007

(54) ENVELOPE WITH INTEGRATED TRACKING LABELS

(75) Inventors: Denis Malette, Orleans (CA); Marcel Duhaime, Drummondville (CA)

(73) Assignee: Relizon Canada Inc., Boucherville, Quebec (CA)

( * ) Notice: Subject to any disclaimer, the term of this patent is extended or adjusted under 35 U.S.C. 154(b) by 436 days.

(21) Appl. No.: 10/918,347

(22) Filed: Aug. 16, 2004

(65) Prior Publication Data

US 2006/0033324 A1 Feb. 16, 2006

(51) Int. Cl.

| | |
|---|---|
| ***B42D 15/00*** | (2006.01) |
| *B65D 27/00* | (2006.01) |
| *B65D 27/06* | (2006.01) |
| *B65D 27/34* | (2006.01) |

(52) U.S. Cl. ..... 283/116; 229/70; 229/300; 229/313

(58) Field of Classification Search ..... 283/106, 283/116; 229/70, 80, 300, 313
See application file for complete search history.

(56) References Cited

U.S. PATENT DOCUMENTS

| | | | | |
|---|---|---|---|---|
| 3,506,186 | A * | 4/1970 | Clemm | 229/300 |
| 5,197,663 | A * | 3/1993 | Stude | 229/303 |
| 5,894,986 | A * | 4/1999 | Lederman et al. | 229/71 |
| 6,120,063 | A | 9/2000 | Petkovsek | |
| 6,133,195 | A | 10/2000 | Murphy | |
| 6,264,033 | B1 * | 7/2001 | Kannabiran et al. | 206/459.1 |
| 2005/0057038 | A1 * | 3/2005 | Crum | 283/106 |
| 2005/0200118 | A1 * | 9/2005 | Buck | 283/62 |

FOREIGN PATENT DOCUMENTS

JP 11165739 A * 6/1999

* cited by examiner

*Primary Examiner*—Boyer D. Ashley
*Assistant Examiner*—Pradeep Battula
(74) *Attorney, Agent, or Firm*—Jacobson Holman PLLC

(57) ABSTRACT

An envelope with integrated tracking labels for forwarding on important documents where proof of delivery and reception is required is described herein. The envelope has a securing flap which is provided with a receipt tear panel formed in a free end section of the flap and provided with a tracking number printed thereon. A glue strip extends longitudinally across an inner face of the securing flap. A release liner is removably retained over the glue strip. A tracking label having the same tracking number is die-cut in the securing flap over the release liner. The release liner is scored to form a tracking label release liner section adhered to the glue strip about the tracking label whereby to retain the tracking label in the securing flap. The glue strip secures the securing flap to an edge section of the other panel when folded thereon on the fold line. The tracking number is also printed on one of the panels. The tracking label is removed from the tracking label release liner of the securing flap as proof of sending or reception of the envelope.

12 Claims, 3 Drawing Sheets

ENVELOPE WITH INTEGRATED TRACKING LABELS

TECHNICAL FIELD

The present invention relates to an envelope with integrated tracking labels detachable from the envelope and providing proof of mailing and reception of the envelope and its contents.

BACKGROUND ART

When shipping important articles in envelopes, such as passports, computer discs, and other such important material, it is necessary to provide proof of mailing and reception of such envelope. Usually this is done by providing envelopes with detachable forms that are filled out, signed by both sender and recipient, and often by the shipper. These forms are usually adhesively secured to the package and copies are detached at the point of expedition to the point of reception. A disadvantage of such forms is that they can be damaged during transport and they require a two-step assembly when making the envelope, namely, the envelope making assembly and the form attaching step. Also, many sheets of paper are required to produce such a form and it is costly. For examples of such mail tracking products, reference is made to U.S. Pat. Nos. 6,120,063 and 6,133,195.

There is therefore a need to provide an envelope which is easy to produce, and preferably from a single paper sheet, and which incorporates therein tracking material to identify the envelope and provide proof of forwarding and reception of such envelope and contents placed therein.

SUMMARY OF INVENTION

It is a feature of the present invention to provide an envelope with integrated tracking labels which overcome the disadvantages of the prior art and which fulfill the required need.

Another feature of the present invention is to provide an envelope which is produced from a single sheet of reinforced paper stock material and which provides a detachable receipt tab as well as one or more tracking labels matching the tracking code printed on the envelope.

Another feature of the present invention is to provide an envelope for mailing important articles such as documents, passport, computer discs, etc. and wherein the envelope has reinforced edges and is provided with integrated tracking labels all formed from the envelope made of reinforced paper stock material.

According to the above features, from a broad aspect, the present invention provides an envelope which comprises a front panel and a rear panel. An edge opening is provided for access to an interior of the envelope between the panels. Sender and receiver address labels are printed on an exterior face of at least one of the panels. A securing flap is formed in one of the panels and projects from a fold line adjacent the edge opening. A receipt tear panel is formed in a free end section of the securing flap and has a tracking number printed thereon. A glue strip extends longitudinally across an inner face of the securing flap. A release liner is removably retained over the glue strip. A tracking label having the tracking number is die-cut in the securing flap over the release liner. The release liner is die-cut to form a tracking label release liner section adhered to the glue strip about the tracking label whereby to retain the tracking label in the securing flap. The glue strip secures the securing flap to an edge section of the other of the panel when folded thereon on the fold line. The tracking number is also printed on one of the panels. The tracking label is removed from the tracking label release liner of the securing flap as proof of sending or reception of the envelope.

According to a further broad aspect of the present invention, there are two of these tracking labels die-cut in a securing flap and each retained therein by respective ones of tracking label release liner sections.

According to a still further broad aspect of the present invention there is provided a tear tab strip formed by perforation lines in the securing flap adjacent the fold line for access to the interior of the envelope when sealed by the securing flap.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
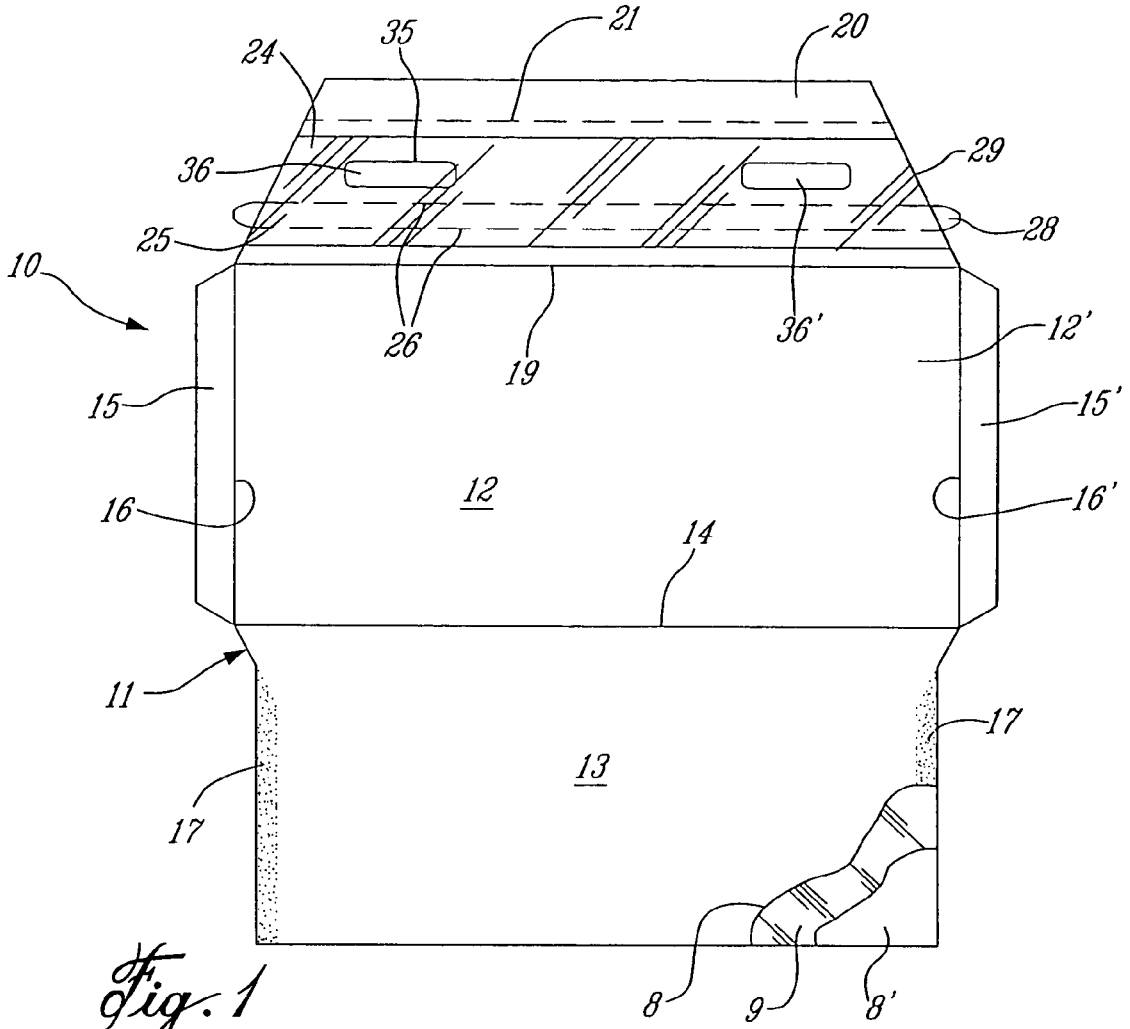
FIG. 1 is a plan view of a single sheet of paper stock material in which the mail envelope of the present invention is die-cut and illustrating the construction of the inner surface of the securing flap.

Referring to the drawings, and more particularly to FIG. 1, there is shown generally at 10 a mail envelope constructed in accordance with the present invention and formed from a sheet of reinforced paper stock material 11. The stock material 11 is formed of two layers of paper 8 and 8' with a layer of plastic film 9 in between. The form is die-cut to form a single sheet blank which defines a front panel 12 and a rear panel 13 interconnected to the front panel by a bottom edge fold line 14. Opposed side edge flaps 15 and 15' are integrally formed with one of the panels, herein the front panel 12 and is inwardly foldable over the interior face 12' of the front panel along fold lines 16 and 16'. An adhesive 17 may be provided along an edge of an inner face 13' of the rear panel to secure to the folded edge flaps 15 and 15', respectively, whereby to form a reinforced envelope along the side edges. These reinforced edges prevent tearing of the envelope during shipment by shifting flat rigid articles placed in the envelope such as computer discs, important documents such as passports, etc. and wherein delivery and proof of reception is mandatory.

As hereinshown a securing flap 18 is formed integral with one of the panels, herein the front panel 12 and projects from a fold line 19 adjacent an edge opening formed by securing the rear panel to the front panel via the side edge flaps. Receipt tear panel 20 is formed in a free end section of the securing flap and detachable therefrom by a perforation line 21.

Figure 2:
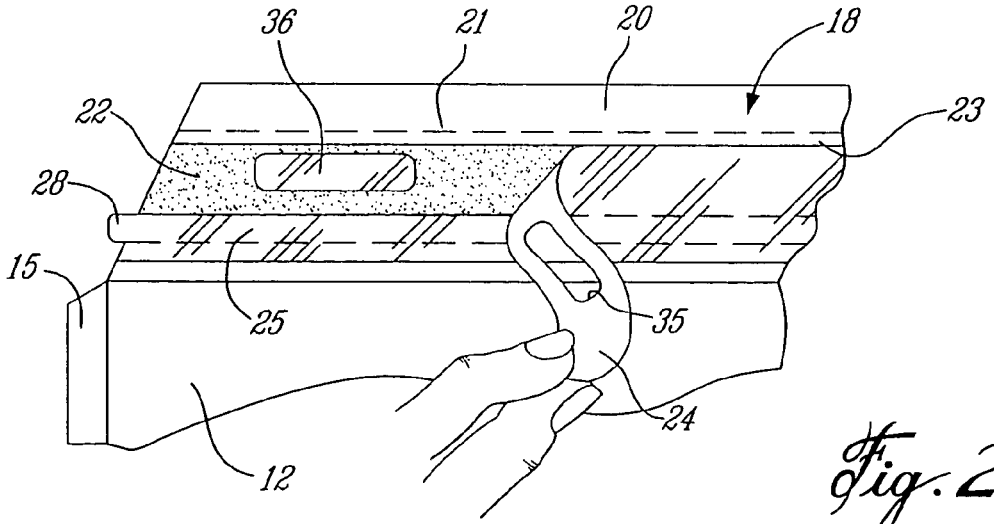
FIG. 2 is a fragmented perspective view illustrating the release liner being removed from the securing flap to expose a glue strip whilst leaving on the glue strip tracking label release liner sections.

With additional reference to FIG. 2, it can be seen that a glue strip 22 extends longitudinally across an inner face 23 of the securing flap 18 with a release liner 24 removably retained over the glue strip. As hereinshown, a tear tab strip 25 is also provided across the securing flap 18 and formed by a pair of perforation lines 26 spaced adjacent the fold line 19 of the securing flap to provide access to the interior of the envelope when sealed by the securing flap. As also herein shown, the glue strip extends over the tear tab strip and the-perforation lines 26 extend through the release liner 24 whereby a section of the release liner will remain attached to the tear strip when removed. The tear strip 25 exceeds the edges 29 of the flap to be readily grasped by the fingers to open the envelope. The end projections 28 may also be colored for ease of location of the tear strip 25.

Figure 3:
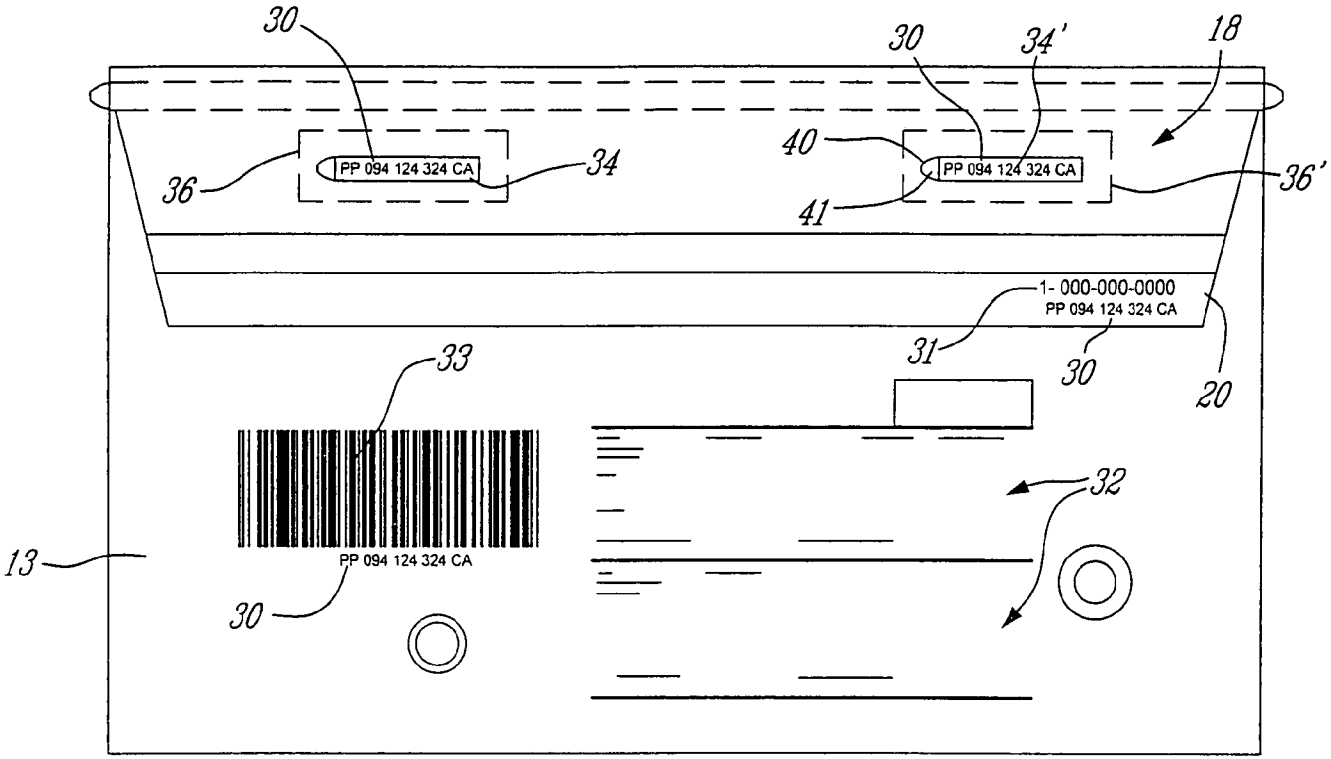
FIG. 3 is a plan view of one of the panels over which the securing flap has been adhesively secured.
Figure 4:
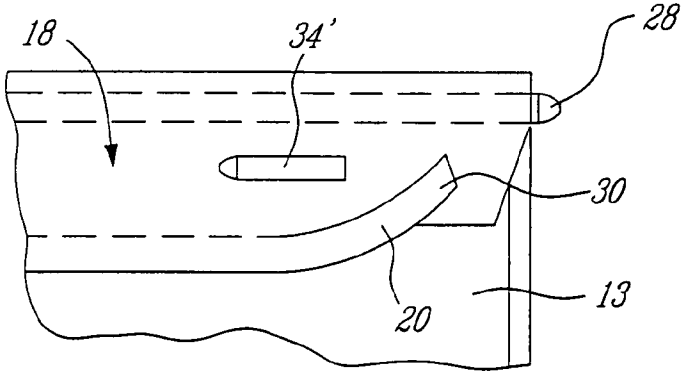
FIG. 4 is a fragmented view of a corner section of the envelope showing the receipt tear panel being detached from the securing flap.

With additional reference now to FIG. 3, it can be seen that the receipt tear panel 20 is provided with a tracking number or code 30 representative of the specific envelope 10 intended to be utilized. The receipt tear panel 20 also contains a telephone number 31 should the sender require information about the location of the envelope after mailing. The telephone number is that of the carrier company handling the delivery of the envelope. After the contents are placed in the envelope, the receipt tear panel is removed from the securing flap 18 and retained by the sender. One of the panels, herein the rear panel 13, is also provided with printed matter 32 to permit the sender to write in his name and address information as well as the receiver name and information. A barcode 33 is also printed on one of the panels for quick identification by scanning equipment as is well known in the art. The tracking number 30 is also printed on one of the panels and matches the tracking number 30 on the receipt tear panel.

Figure 6:
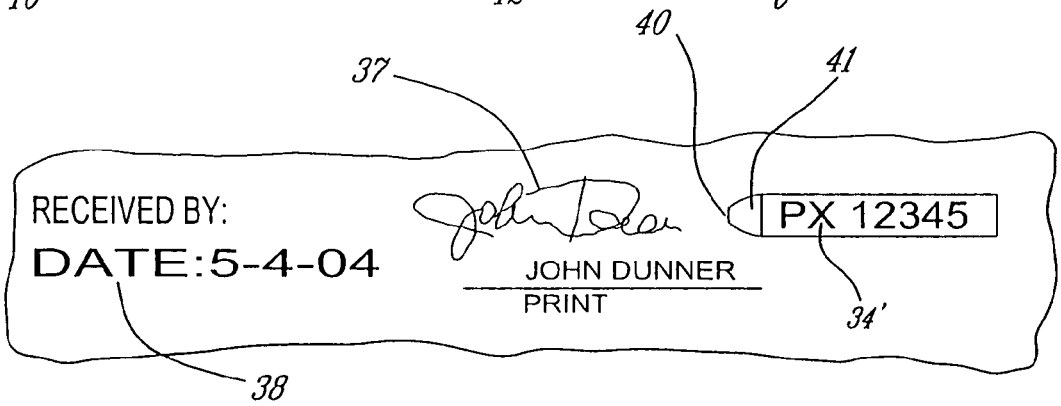
FIG. 6 is a fragmented view of a form or record keeping sheet showing the use of a tracking label which has been removed from the mail envelope of the present invention.

Once the contents are placed in the envelope, in order to seal the securing flap, it is necessary to remove the release liner 24 as shown in FIG. 2. When the release liner is removed, the glue strip 22 is exposed to seal the securing flap to one of the panels. As shown in FIGS. 1 to 3, the securing flap 18 is also provided with at least one, herein two, tracking labels 34 and 34', each of which is also provided with the tracking number 30. These tracking labels 34 and 34' are die-cut in the securing flap over the release liner 24. The release liner 24 is also die-cut at 35 to form a tracking label release liner 36 which is better illustrated in FIG. 2 and which is also adhered to the glue strip 22 about the tracking labels 34 and 34'. These tracking label release liner sections 36 and 36', shown in FIG. 1, retain their respective tracking labels 34 and 34' in the securing flap 18. There may be provided one or two or more of the tracking labels 34 and 34' depending on the intended use of the envelope. In this particular application where there are two tracking labels, one of the labels is removed by the sender for his particular use for record keeping. These tracking labels have the adhesive 22 on the backside thereof and therefore can be stuck into record keeping ledgers, etc. The other tracking label may be retained by the transporter as proof of delivery and, as shown in FIG. 6, it is stuck also in a ledger book together with the signature 37 of the receiver person. The ledger book would also contain a date of delivery, such as indicated by reference numeral 38.

Figure 5:
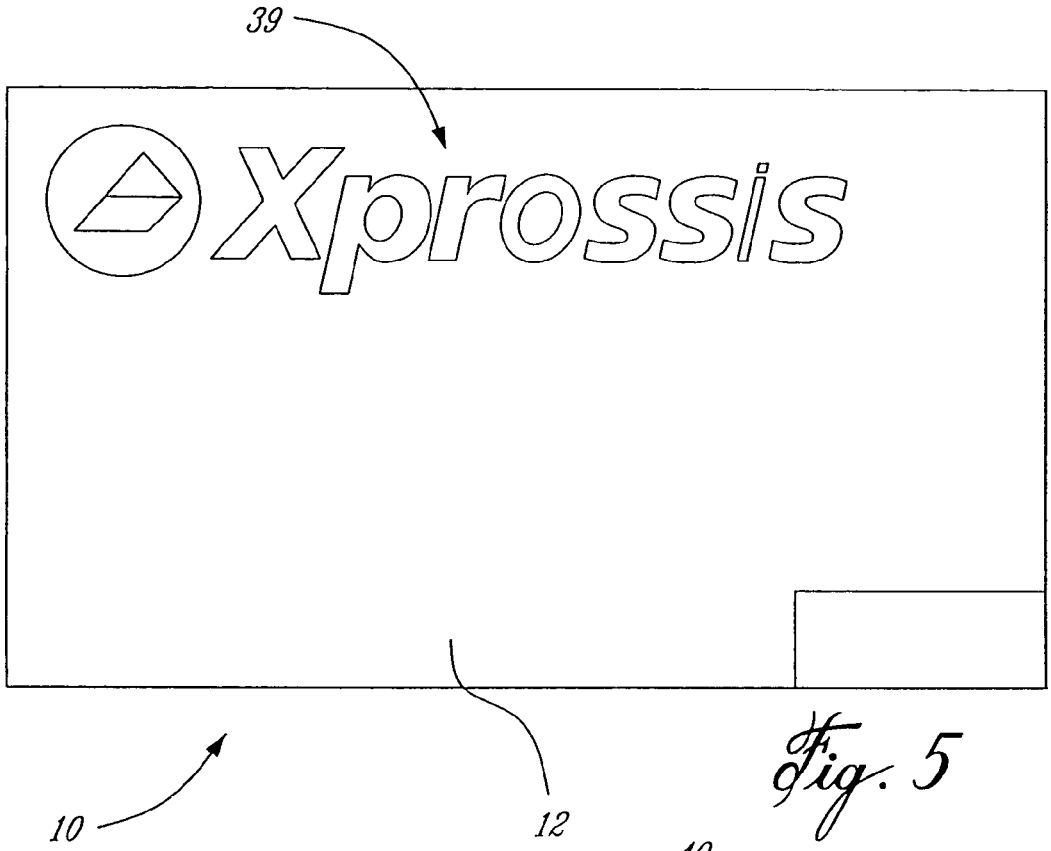
FIG. 5 is a plan view of the other panel.

FIG. 5 illustrates the front panel and as hereinshown, it only contains wording 39 indicative of the use of the envelope 10 such as prepaid express post delivery to identify the nature of the envelope to the transporter.

Figure 7:
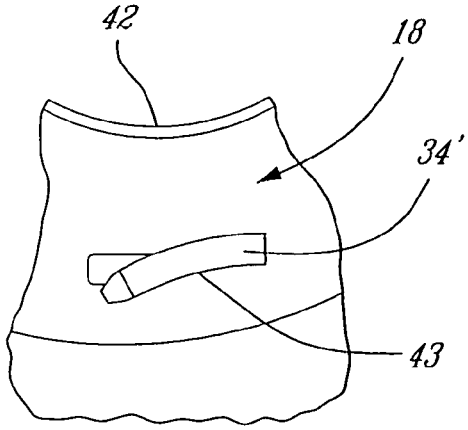
FIG. 7 is a fragmented perspective view showing a manner in which a tracking label can be removed from the envelope.

Detachable tracking labels 34 and 34' are small narrow tracking labels formed integral with the securing flap and these may have other shapes. These tracking labels, as hereinshown, are formed with a rounded end 40 whereby to identify the grasping end for the removal of same from the securing flap. The rounded end also has a solid color 41 for easy identification. These labels are grasped from this end by inserting the fingernail under the rounded end and simply peeling it off. They can also be removed by applying a folding force by the fingers to form a fold 42 in the securing flap as shown in FIG. 7 and extending across an end section of the tracking labels whereby an end section of the label becomes automatically detached from the tracking label release liner 36 or 36'.

It is within the ambit of the present invention to cover any obvious modifications of the preferred embodiment described herein provided such modifications fall within the scope of the appended claims.

The invention claimed is:

1. An envelope comprising a front panel and a rear panel, an edge opening for access to an interior of said envelope between said panels, sender and receiver address labels printed on an exterior face of at least one of said panels, a securing flap formed in one of said panels and projecting from a fold line adjacent said edge opening, a receipt tear panel formed in a free end section of said securing flap and having a tracking number printed thereon, a glue strip extending longitudinally across an inner face of said securing flap, a release liner removably retained over said glue strip, a tracking label having said tracking number die-cut in said securing flap over said release liner, said release liner being die-cut to form a tracking label release liner section adhered to said glue strip about said tracking label whereby to retain said tracking label in said securing flap, said glue strip securing said securing flap to an edge section of the other of said panel when folded thereon on said fold line, said tracking number being printed on one of said panels, said tracking label being removed from said securing flap from said tracking label release liner of said securing flap as proof of sending or reception of said envelope.

2. An envelope as claimed in claim 1 wherein there are two of said tracking labels die-cut in said securing flap and each retained therein by respective ones of said tracking label release liner sections.

3. An envelope as claimed in claim 2 wherein one of said tracking labels is removed and affixed to a record keeping sheet by a delivery party and adjacent a signature of a person receiving said envelope as proof of delivery.

4. An envelope as claimed in claim 1 wherein a tracking bar code is also printed on one of said panels and representative of said tacking number.

5. An envelope as claimed in claim 1 wherein there is further provided a tear tab strip formed by perforation lines in said securing flap adjacent said fold line for access to said interior of said envelope when sealed by said securing flap.

6. An envelope as claimed in claim 3 wherein said receipt tear panel is also provided with a telephone number printed thereon for access to said delivery party.

7. An envelope as claimed in claim 1 wherein said envelope is formed from a sheet of paper stock material and die-cut has a single sheet blank defining said front and rear panels interconnected by a bottom edge fold line, opposed side edge flaps integrally formed with one of said panels and inwardly foldable over an interior face of said one of said panels on fold lines, and an adhesive for securing said inwardly folded side edge flaps to said other panel when folded thereover on said bottom edge fold line.

8. An envelope as claimed in claim 7 wherein said side edge flaps are reinforcing flaps to reinforce the side edges of said envelope to prevent said envelope from tearing during shipment by shifting of flat rigid articles placed in said envelope.

9. An envelope as claimed in claim 8 wherein said envelope is for mailing important documents such as passports and wherein proof of mailing and reception is mandatory.

10. An envelope as claimed in claim 2 wherein said tracking labels are small narrow tracking labels formed integral with said securing flap, said tracking labels having a rounded end to identify a grasping end for the removal thereof.

11. An envelope as claimed in claim 10 wherein said rounded end has a portion thereof printed with a solid color for easy identification, said tracking labels, said labels being also accessible by applying a folding force to form a fold line in said securing flap across an end of said tracking labels.

12. An envelope as claimed in claim 7 wherein said paper stock material is a reinforced paper stock material comprised of two layers of paper with a layer of plastic film therebetween.

* * * * *